US008850661B2

(12) United States Patent
Liermann

(10) Patent No.: US 8,850,661 B2
(45) Date of Patent: Oct. 7, 2014

(54) DOOR HINGE FOR HIDDEN PLACEMENT BETWEEN DOOR FRAME AND DOOR LEAF, AND DOOR PROVIDED WITH THE DOOR HINGE

(75) Inventor: Nicolas Liermann, Rheda-Wiedenbrueck (DE)

(73) Assignee: Simonswerk, Gesellschaft mit beschraenkter Haftung, Rheda-Wiedenbrueck (DE)

( * ) Notice: Subject to any disclaimer, the term of this patent is extended or adjusted under 35 U.S.C. 154(b) by 0 days.

(21) Appl. No.: 13/346,244

(22) Filed: Jan. 9, 2012

(65) Prior Publication Data

US 2012/0180396 A1 Jul. 19, 2012

(30) Foreign Application Priority Data

Jan. 14, 2011 (DE) ..... 10 2011 000 150

(51) Int. Cl.
*E05D 11/06* (2006.01)
*E05D 3/18* (2006.01)

(52) U.S. Cl.
CPC ..... *E05D 3/186* (2013.01); *E05Y 2900/132* (2013.01)
USPC ..... 16/357; 16/366; 16/370; 49/398

(58) Field of Classification Search
USPC ..... 49/381, 397–400; 16/357, 361, 362, 16/366, 370
See application file for complete search history.

(56) References Cited

U.S. PATENT DOCUMENTS

| | | | | | |
|---|---|---|---|---|---|
| 825,943 | A * | 7/1906 | Soss | 16/358 |
| 880,697 | A * | 3/1908 | Soss | 16/357 |
| 1,484,093 | A * | 2/1924 | Soss | 16/358 |
| 1,687,271 | A * | 10/1928 | Soss | 16/358 |
| 1,688,996 | A * | 10/1928 | Soss | 16/358 |
| 1,772,559 | A * | 8/1930 | Soss | 16/357 |
| 1,832,174 | A * | 11/1931 | Zahner et al. | 49/254 |
| 1,925,209 | A * | 9/1933 | Schwartz | 16/358 |
| 2,100,928 | A * | 11/1937 | Way | 16/358 |
| 2,122,034 | A * | 6/1938 | Jackle | 16/358 |
| 2,178,271 | A * | 10/1939 | Soss | 16/358 |
| 3,626,548 | A * | 12/1971 | Grunert | 16/358 |
| 4,068,348 | A * | 1/1978 | Chivers | 16/235 |
| 6,487,755 | B1 * | 12/2002 | Caldari | 16/370 |
| 7,861,378 | B2 * | 1/2011 | Neukötter | 16/366 |
| 8,196,265 | B2 * | 6/2012 | Neukoetter et al. | 16/389 |

FOREIGN PATENT DOCUMENTS

| | | |
|---|---|---|
| DE | 200 23 445 | 6/2004 |
| DE | 101 53 778 | 7/2004 |
| DE | 10 2005 039 509 | 6/2006 |
| DE | 10 2008 027 209 | 7/2009 |

* cited by examiner

*Primary Examiner* — Katherine Mitchell
*Assistant Examiner* — Abe Massad
(74) *Attorney, Agent, or Firm* — Michael J. Striker

(57) ABSTRACT

In a door hinge for hidden placement between a door frame and a door leaf a first hinge rod is rotatably mounted on a door frame receiving body at one end and at another end is guided rotatably and displaceably in a slot link guide of a door leaf receiving body, a second hinge rod is rotatably mounted on the door leaf receiving body at one end and at another end is guided rotatably and displaceably in a slot link guide of the door frame receiving body, disposed at an angle of at least 45° relative to front surfaces of the door leaf in a closed position, and a depth of the door frame receiving body is less than 80% of a depth of the door leaf receiving body.

13 Claims, 5 Drawing Sheets

DOOR HINGE FOR HIDDEN PLACEMENT BETWEEN DOOR FRAME AND DOOR LEAF, AND DOOR PROVIDED WITH THE DOOR HINGE

CROSS-REFERENCE TO RELATED APPLICATION

The invention described and claimed hereinbelow is also described in German Patent Application DE 10 2011 000 150.6 filed on Jan. 14, 2011. This German Patent Application, whose subject matter is incorporated here by reference, provides the basis for a claim of priority of invention under 35 U.S.C. 119(a)-(d).

BACKGROUND OF THE INVENTION

The invention relates to a door hinge for hidden placement between the door frame and the door leaf.

More particularly, it relates to a door hinge having a door leaf receiving body which can be inserted in a recess in a narrow side of the door leaf, a door frame receiving body which can be inserted in a recess in an inner side of the door frame, a first and a second hinge rod which are connected in a manner that allows pivoting about a vertical connection axis, wherein the first hinge rod is mounted at one end on the door frame receiving body in a manner that permits rotation about a frame-side vertical axis, and, at the other end thereof, is guided in a rotatable and displaceable manner in a slot link guide of the door leaf receiving body, wherein the second hinge rod is mounted at one end on the door leaf receiving body in a manner that permits rotation about a door leaf-side vertical axis and, at the other end thereof, is guided in a rotatable and displaceable manner in a slot link guide of the door frame receiving body, and wherein the door frame receiving body and the door leaf receiving body have an offset in a first horizontal direction which extends perpendicularly to the front surfaces of the door leaf in the closed position thereof.

Due to the offset, the door hinge can be used when precise placement of the receiving bodies opposite one another is not possible, e.g. when an additional lamination is provided on the door frame.

A door hinge having the initially described features is known from DE 200 23 445 U1. The door hinge is asymmetrically configured and has an offset in the horizontal direction. The door frame receiving body is disposed behind a plate-shaped lamination, wherein the offset corresponds approximately to the thickness of the lamination. The two receiving bodies have straight slot link guides which, in the closed position of the door leaf, extend along a second horizontal direction which extends parallel to the front surfaces of the closed door leaf. The two receiving bodies have considerable depth, and therefore recesses having a matching depth must be provided in the door frame and the door leaf. To enable the door leaf to swivel open without jamming, the lamination is furthermore shortened relative to the part of the door frame adjacent thereto to the rear, and therefore a relatively wide gap extending in a stepped manner forms on the outer side of the door. The appearance of the entire door is impaired as a result.

DE 10 2008 027 209 B3 makes known a door hinge, in which the two receiving bodies not only have an offset in the first horizontal direction, but also overlap perpendicularly thereto in the second horizontal direction. This is achieved in that, when a door leaf is folded, the door leaf receiving body has a projection, wherein a door leaf-side vertical axis, on which one of two interacting hinge rods is rotatably mounted, is disposed in the region of this projection. This door hinge is therefore not suitable for aligned placement of door leaf and door frame. Each of the slot link guides formed in the receiving bodies is straight.

DE 10 2005 039 509 B3 makes known a door hinge for hidden placement between door frame and door leaf, which can be inserted using receiving bodies into recesses in the door leaf and the door frame. The door hinge comprises a first and a second hinge rod which are interconnected in a manner that allows pivoting about a vertical connection axis. In contrast to the previously described hidden door hinges, one of the two hinge rods is connected at both ends thereof to the receiving bodies only in a pivotable manner, while the other hinge rod is guided at both ends thereof in slot link guides in a rotatable and closeable manner. Both slot link guides are S-shaped.

A door hinge, which is substantially symmetrical in the top view, for hidden placement between door frame and door leaf is known from DE 101 53 778 B4, wherein the two interacting hinge rods, which are interconnected in a manner that permits pivoting about a vertical connection axis, are each rotatably supported at one end and, at the other end thereof, are guided in a rotatable and displaceable manner in straight slot link guides of assigned receiving bodies. The receiving bodies comprise adjusting means which permit positioning in the vertical direction and in the horizontal direction.

SUMMARY OF THE INVENTION

The problem addressed by the invention is that of providing a door hinge having receiving bodies which are offset relative to one another in the first horizontal direction, in the case of which the space required for placement of the door hinge is minimized on the frame side.

According to the invention the slot link guide of the door frame receiving body either extends straight and is positioned at an angle of at least 45° relative to the front surfaces of the door leaf in the closed position thereof, or is arcuate, wherein the depth of the door frame receiving body that is determined in a second horizontal direction perpendicularly to the first horizontal direction with a door leaf closed is less than 80% of the depth of the door leaf receiving body.

To permit a swivel motion of the door leaf by preferably 180°, the two slot link guides must have an adequate length. Furthermore, the placement and shape of the slot link guides determine the kinematics of the swivel motion.

According to a first embodiment of the invention, the slot link guide of the door frame receiving body is straight, but is different from the generally known designs relative to the front surfaces of the door leaf in the closed position thereof, i.e. angled greatly relative to the second horizontal direction y, namely by at least 45°. While, in all known embodiments, the displaceable ends of the hinge rods substantially enter the assigned receiving bodies when the door hinge moves, the slot link guide of the door frame receiving body according to the first embodiment extends at an angle of more than 45°, i.e. extends across a greater length along the first horizontal direction than along the second horizontal direction. The depth to be determined in the second horizontal direction can therefore be kept to a minimum. Despite this very oblique extension which is angled by preferably between 50° and 75°, in particular by more than approximately 60°, the door leaf can be swiveled in the desired manner. Within the scope of the invention, the slot link guide of the door frame receiving body can be designed having the oblique position described in particular due to the asymmetry of the door hinge and the offset between the receiving bodies in the first horizontal direction.

According to a second embodiment of the invention, the slot link guide of the door frame receiving body is arcuate. By way of the arcuate embodiment of the slot link guide of the door frame receiving body, it is initially possible to use the available installation space in an optimal manner, wherein a sufficient length of the corresponding slot link guide can be ensured even given a relatively low installation depth of the door frame receiving body. Within the scope of the invention, the arcuate embodiment of the slot link guide furthermore permits swiveling about an obstacle, in particular a frame-side laminate.

The slot link guide of the door frame receiving body is advantageously designed such that the door frame-side end of the second hinge rod is initially guided substantially in the first horizontal direction during motion starting from the closed position of the door leaf. By way of the portion of the slot link guide of the door frame receiving body extending in the first direction, a swivel path is provided that does not increase the depth of the door frame receiving body. Furthermore, the shape described makes it possible for the door leaf to be opened only slightly at the beginning of the swivel motion, and therefore, due to the interaction of the hinge rods, the door leaf-side vertical axis is moved away from the door frame receiving body. The gap between the door frame receiving body and the door leaf receiving body, which is typically small, is enlarged to the extent that the door leaf can be rotated without jamming. The slot link guide of the door frame receiving body can be designed approximately as a circular arc, for example.

While the objective within the scope of the invention is to achieve the smallest possible recess in the door frame, deeper recesses can also be easily created in the door leaf without substantially impairing the stability of the door leaf. Proceeding from this background it is advantageous to design the slot link guide of the door leaf receiving body to be straight, wherein an extension of the slot link guide is preferably provided, which is oblique relative to the horizontal direction in the closed position.

Considerable space savings can be achieved by way of the curved or oblique design of the slot link guide of the door frame receiving body that was described. Therefore, according to a preferred embodiment of the invention, the depth of the door frame receiving body is between 55 and 70% of the depth of the door leaf receiving body.

The offset between the door leaf receiving body and the door frame receiving body is typically more than 10 mm and preferably less than 25 mm. The offset is selected such that the door leaf receiving body is displaced in the direction of the outer side of the door. The outer side of the door is described as the side of the door, in the direction of which the door leaf is opened. If the two receiving bodies have different widths in the first horizontal direction, the offset must be determined from the center of the each of the receiving bodies relative to the first horizontal direction. The door hinge is furthermore preferably designed such that the door leaf can be swiveled about 180° without jamming. In the closed position, the outer front surface of the door leaf is preferably aligned with the outer surface of the door frame. In particular, it can be provided that, when the door hinge is placed on a door, the door frame receiving body is located behind a non-milled out, plate-shaped laminate having a thickness of at least 10 mm.

To achieve the kinematics of the door hinge that were described, the two hinge rods have different shapes as seen in the top view. When a door leaf is closed, the connecting line between the connection axis and the door leaf-side axis and the connecting line between the connection axis and the frame-side axis preferably forms an angle between 40° and 60°. In the case of a door hinge, relative to the closed position, the door leaf-side vertical axis and the frame-side vertical axis are preferably located directly adjacent to the gap remaining between the receiving bodies and in the direction of the outer side of the door. Furthermore, when a door is closed, the frame-side end of the second hinge rod, the vertical connection axis and the door leaf-side vertical axis are located one behind the other in the first direction from the inner side of the door to the outer side of the door. The frame-side vertical axis and the door leaf-side end of the first hinge rod can be located in the first horizontal direction approximately at the same level between the connection axis and the door leaf-side vertical axis. In the second horizontal direction, proceeding from the door frame in the direction of the door leaf, the frame-side end of the second hinge rod, the frame-side axis, the connection axis, the door leaf-side axis, and the door leaf-side end of the first hinge rod are preferably located one behind the other.

To achieve a high load-carrying capacity, the hinge rods are preferably designed as a single piece. For example, one of the hinge rods can be H-shaped, wherein the other hinge rod can be forked, having a vertical section at one end, and horizontal fork arms extending away therefrom toward the other end.

The door hinge can be adjustable in the vertical direction and at least one horizontal direction, preferably in two horizontal directions. Appropriate means for adjustment are advantageously provided on the receiving bodies, which can comprise slots or mutually displaceable parts for that purpose.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
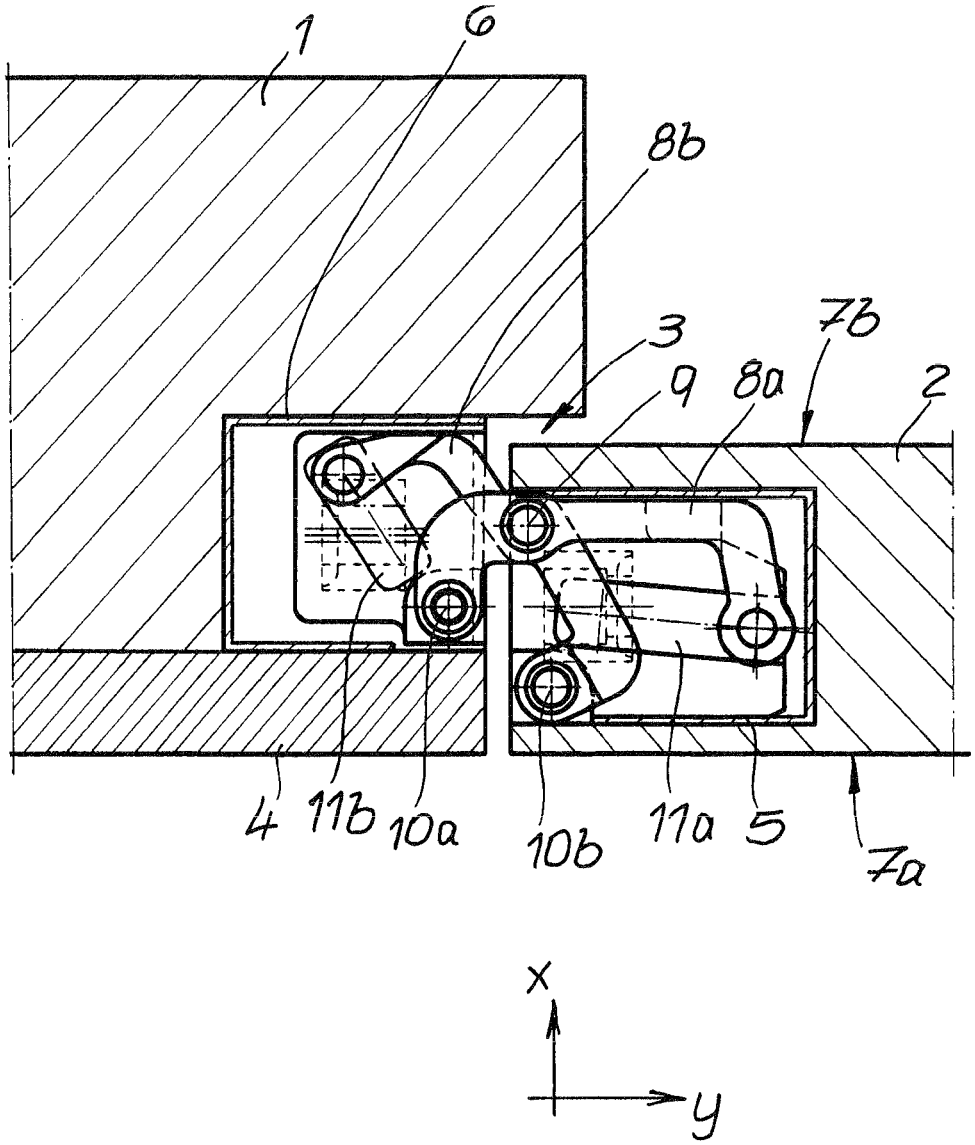
FIG. 1 a sectional view of a closed door comprising a door hinge in accordance with the present invention, FIG. 2 the door according to FIG. 1, with a door leaf fully opened in accordance with the present invention, FIG. 3 a sectional view of a closed door in accordance with the present invention, FIG. 4 the depiction according to FIG. 3, with a door leaf swiveled by 90° in accordance with the present invention, FIG. 5 the door according to FIG. 3, with a door leaf fully opened in accordance with the present invention.
Figure 2:
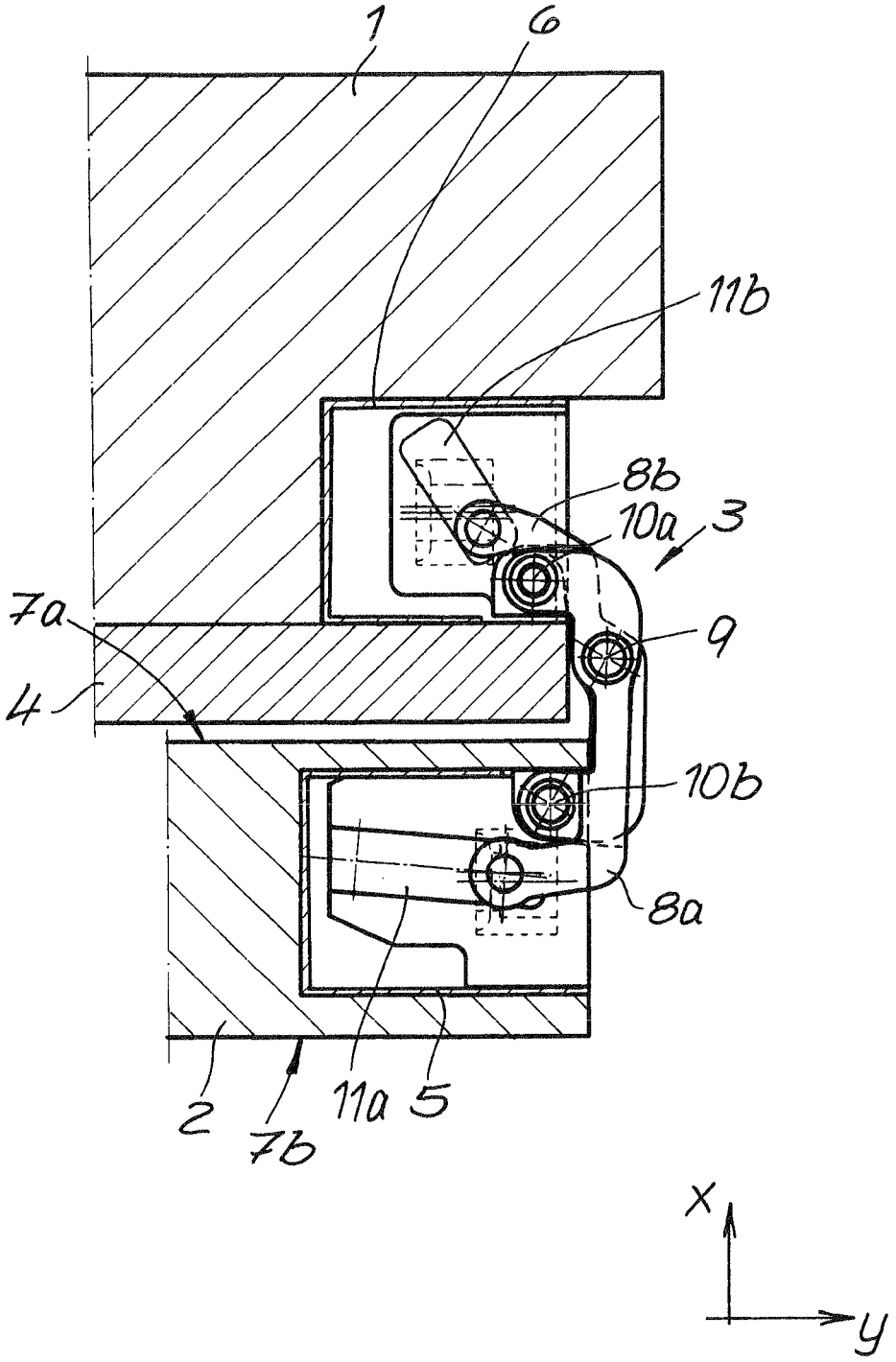

FIGS. 1 and 2 show a door comprising a door frame 1, a door leaf 2, and a door hinge 3 hidden between the door frame 1 and the door leaf 2. A non-milled out, plate-shaped laminate 4 is provided on the door frame 1 on the outer side of the door, and can be paneling, wallboard, fiberboard, a plastering layer or the like, for example. In order to position the door leaf 2 in alignment with the outer side despite the laminate, a door leaf receiving body 5 which is inserted in a recess in a narrow side of the door leaf 2, and a door frame receiving body 6 which is inserted in a recess in an inner side of the door frame 1, have an offset between 10 mm and 25 mm in a first horizontal direction x which extends perpendicularly to the front surfaces 7*a*, 7*b* of the door leaf 2 in the closed position thereof. The door hinge 3 furthermore comprises a first hinge rod 8*a* and a second hinge rod 8*b* which are interconnected in a manner that allows pivoting about a vertical connection axis 9.

The first hinge rod 8*a* is mounted on the door frame receiving body 6 at one end in a manner that allows rotation about a frame-side vertical axis 10*a*, and, at the other end thereof, is guided rotatably and displaceably in a slot link guide 11*a* of the door leaf receiving body 5. The second hinge rod 8*b* is mounted in a similar manner on the door frame receiving body 5 at one end in a manner that allows rotation about a door leaf-side vertical axis 10*b*, and, at the other end thereof, is guided rotatably and displaceably in a slot link guide 11*b* of the door frame receiving body 6.

In the embodiment according to FIGS. 1 and 2, the slot link guide 11*b* of the door frame receiving body 6 is straight, and is disposed at an angle of at least 45° relative to the front surfaces of 7*a*, 7*b* of door leaf 2 in the closed position thereof. The angle relative to the corresponding second horizontal direction y is preferably between 50° and 75°, in particular approximately 60°. By way of the above-described oblique extension of the slot link guide 11*b* of the door frame receiving body 6 having a greater extension along the first horizontal direction x than along the second horizontal direction y, a particularly low depth of the door frame receiving body 6 is achieved. In addition, the slot link guide 11*b* of the door frame receiving body is also markedly shorter than the slot link guide 11*a* of the door leaf receiving body 5. Such an embodiment is possible due to the pronounced asymmetry of the door hinge 3 and due to the offset between the two receiving bodies 5, 6 along the first direction x. By way of the kinematics shown, the door leaf 2 can be swiveled about the laminate 4, and can be opened by up to 180° without jamming.

The slot link guide 11*a* of the door leaf receiving body 5 is also straight and extends slightly obliquely relative to the second horizontal direction y. The door frame receiving body 6 can be designed with a relatively low installation depth in the direction y due to an arcuate curvature of the slot link guide 11*b* thereof. For instance, the depth of the door frame receiving body 6 is less than 80% of the depth of the door leaf receiving body 5. In the specific embodiment, the relationship is approximately 65%.

The hinge rods 8*a*, 8*b*, which are depicted only in the top view, are preferably one-piece, to achieve the greatest possible load-carrying capacity. For example, one of the hinge rods 8*a*, 8*b* can be H-shaped, wherein the other hinge rod 8*b*, 8*a* can be forked, having a vertical section at one end, and horizontal fork arms extending away therefrom toward the other end. Such hinge rods 8*a*, 8*b* are described in DE 101 53 778 B4. Proceeding from a preferred one-piece embodiment, both hinge rods can also have an L-shape, however, each one having a vertical section and a horizontal section extending away therefrom, or a "U" shape having two vertical sections which are connected at one side by a horizontal section.

Figure 3:
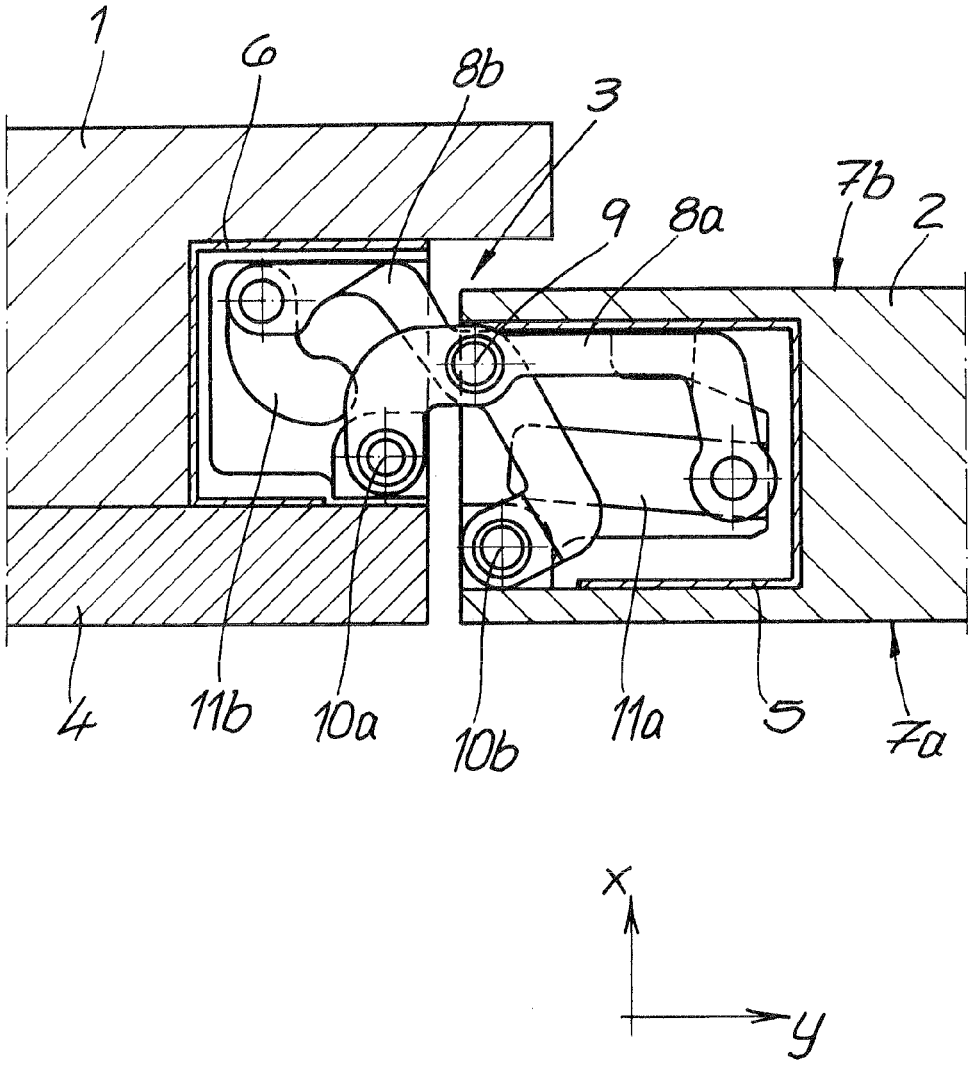
Figure 4:
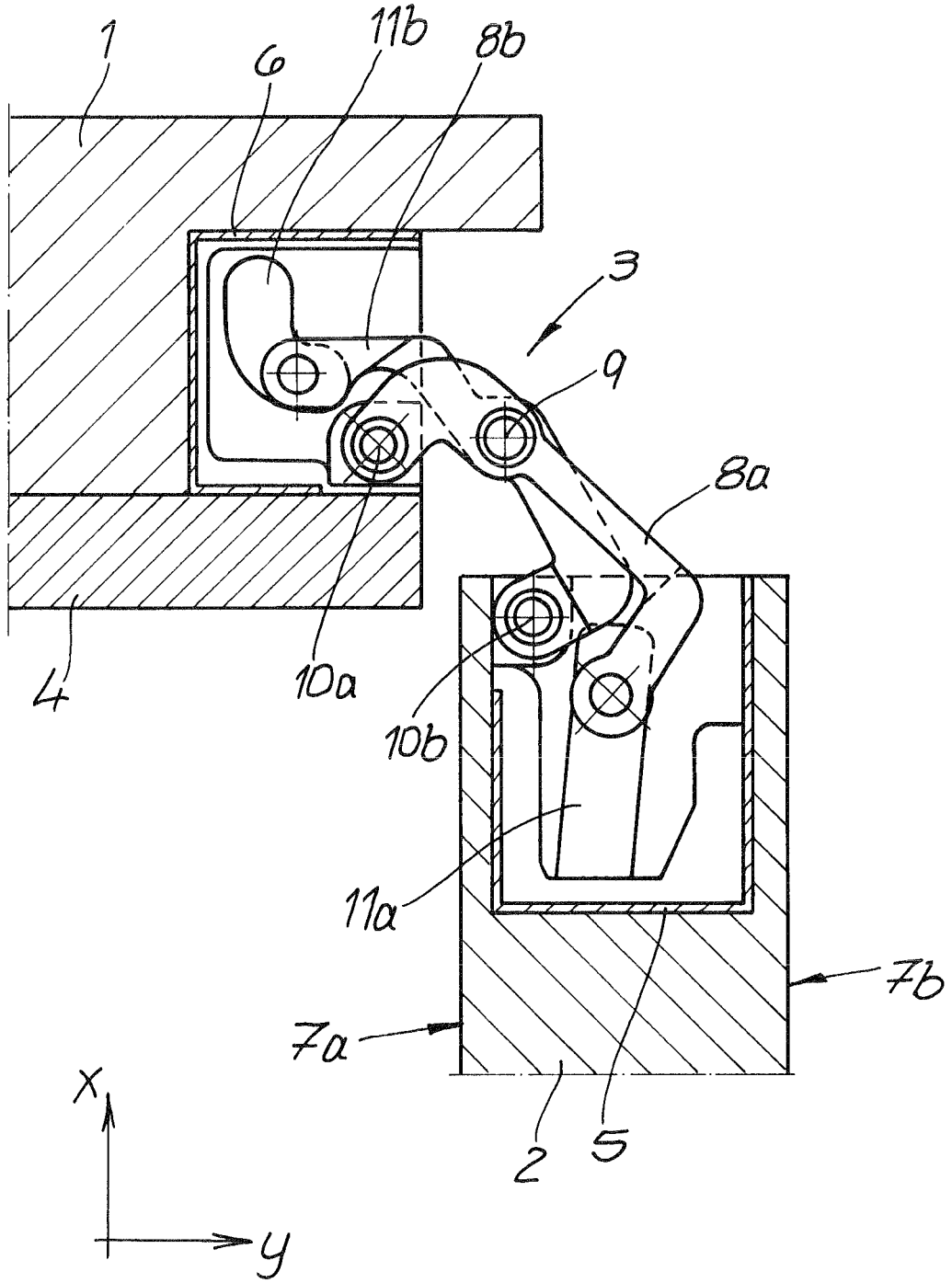
Figure 5:
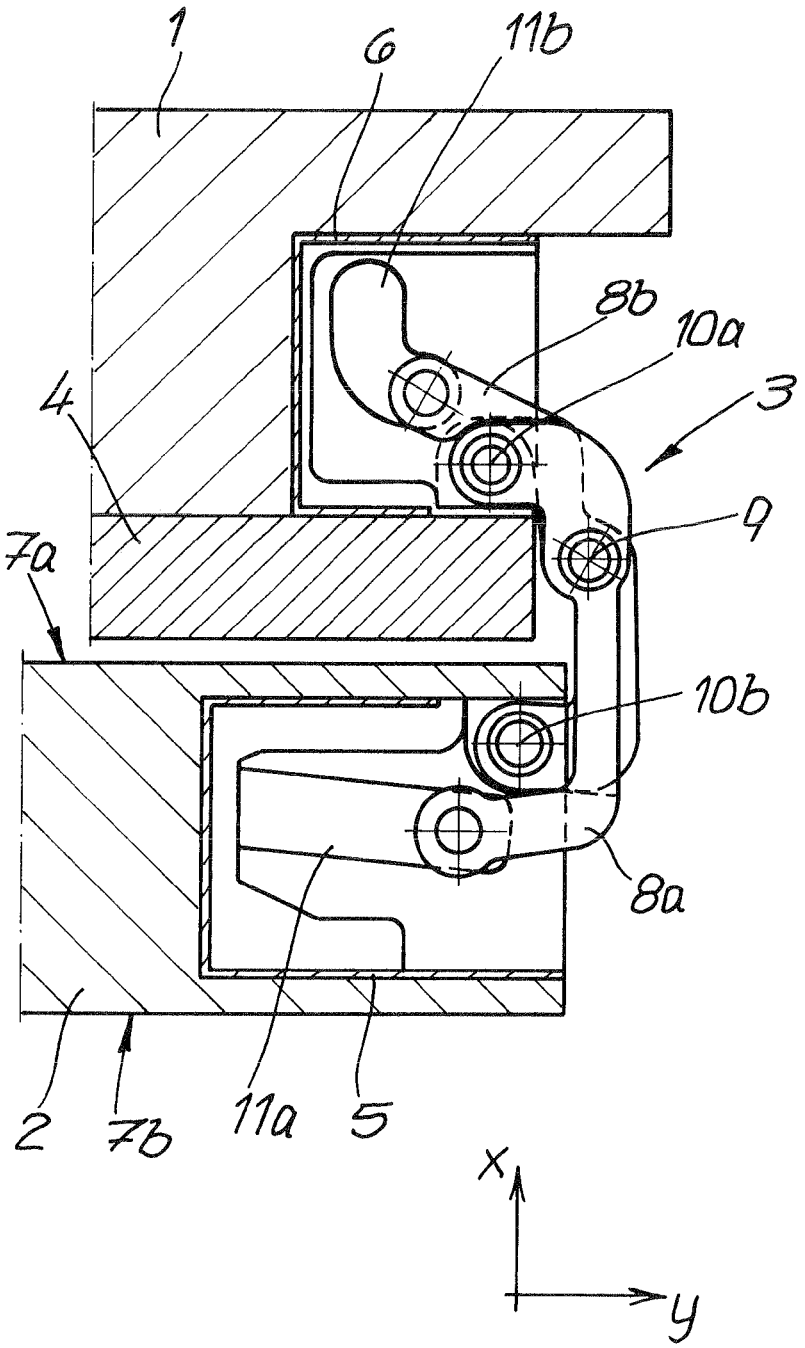

According to the embodiment depicted in FIGS. 3 to 5, the slot link guide 11*b* of the door frame receiving body 6 is arcuate, wherein, starting from the closed position of the door leaf 2, the corresponding end of the second hinge rod 8*b* is initially guided approximately in the first horizontal direction x before this end is then moved substantially perpendicularly to the first horizontal direction x in a second horizontal direction y on the slot link guide 11*b* of the door frame receiving body 6, which is designed approximately in the shape of a circular arc, to the end of the swivel motion. The further design of the door hinge 3 corresponds substantially to the embodiment according to FIG. 1 and FIG. 2.

By way of the arcuate design of the slot link guide 11*b* of the door frame receiving body 6, it is also possible, in combination with the further slot link guide 11*a* and the geometry of the hinge rods 8*a*, 8*b*, for the door leaf 2 to be swiveled about the laminate 4 by up to 180° without jamming. By way of the curved course of the slot link guide 11*b* of the door frame receiving body 6, it is therefore possible for the door leaf-side vertical axis 10*b*, about which the door leaf 2 swivels during the opening motion, to initially move substantially in the second horizontal direction y away from the door frame 1, i.e. the door frame receiving body 6, in order to create a larger gap to enable the door leaf 2 to rotate without jamming. Even given a pivot angle of 90° (FIG. 4), the entire narrow side of the door leaf 2 is still located at a distance from the door frame receiving body 6 in the second horizontal direction y.

FIG. 5 shows the door leaf 2 in the fully opened state, wherein the ends of the hinge rods 8*a*, 8*b*, which have been guided into the slot link guides 11*a*, 11*b*, have reached the end position thereof.

It will be understood that each of the elements described above, or two or more together, may also find a useful application in other types of constructions differing from the types described above.

While the invention has been illustrated and described as embodied in a door hinge for hidden placement between door frame and door leaf, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A door hinge for hidden placement between a door frame and a door leaf, comprising a door leaf receiving body insertable in a recess in a narrow side of the door leaf, said door leaf receiving body comprising a slot link guide and a receptacle for a leaf-side vertical axis;

a door frame receiving body insertable in a recess in an inner side of the door frame, said door frame receiving body comprising a slot link guide and a receptacle for a frame-side vertical axis;

a first and a second hinge rod connected in a manner allowing pivoting about a vertical connection axis, wherein said first hinge rod is mounted on said door frame receiving body at one end in a manner allowing rotation about said frame-side vertical axis and at another end is guided rotatably and displaceably in said slot link guide of said door leaf receiving body, wherein said second hinge rod is mounted on said door leaf receiving body at one end in a manner allowing rotation about said door leaf-side vertical axis and at another end is guided rotatably and displaceably in said slot link guide of said door frame receiving body, wherein said first and second hinge rods rotate relative to the vertical axis and are rotatably and replaceably guided in the respective slot link guides during an opening or closing movement of the door leaf, wherein said door frame receiving body and said door leaf receiving body have an offset in a first horizontal direction which extends perpendicularly to front surfaces of the door leaf in a closed position thereof, wherein said slot link guide of said door frame receiving body is the slot link guide selected from the group consisting of a straight slot link guide disposed at an angle of at least 45° relative to front surfaces of the door leaf in a closed position thereof and an arcuate slot link guide, wherein a depth of said door frame receiving body, that is determined in a second horizontal direction perpendicularly to said first horizontal direction with the door leaf closed is less than 80% of a depth of said door leaf receiving body, and wherein the front surfaces of the door leaf define a plane extending in parallel to a longitudinal axis of the door leaf receiving body.

2. A door hinge for hidden placement between a door frame and a door leaf as defined in claim 1, wherein said slot link guide of said door frame receiving body is formed so that a door frame-side end of said second hinge rod is initially guided substantially in said first horizontal direction during a motion starting from the closed position of the door leaf.

3. A door hinge for hidden placement between a door frame and a door leaf as defined in claim 1, wherein said slot link guide of said door frame receiving body is formed as a circular arc.

4. A door hinge for hidden placement between a door frame and a door leaf as defined in claim 1, wherein said slot link guide of said door frame receiving body is straight and positioned at an angle of between 50° and 75° relative to the front surfaces of the door leaf in the closed position.

5. A door hinge for hidden placement between a door frame and a door leaf as defined in claim 1, wherein said slot link guide of said door frame receiving body is formed so that the end of said second hinge rod, which is guided in said slot link guide of said door frame receiving body, is moved during an opening motion in a direction of the door leaf relative to said first horizontal direction in the opening position.

6. A door hinge for hidden placement between a door frame and a door leaf as defined in claim 1, wherein said slot link guide of said door leaf receiving body is straight and extends obliquely relative to said second horizontal position in the closed position.

7. A door hinge for hidden placement between a door frame and a door leaf as defined in claim 1, wherein said door frame receiving body has a depth substantially between 55% and 75% of a depth of said door leaf receiving body.

8. A door hinge for hidden placement between a door frame and a door leaf as defined in claim 1, wherein said door leaf receiving body and said door frame receiving body have an offset which is more than 10 mm and less than 25 mm.

9. A door hinge for hidden placement between a door frame and a door leaf as defined in claim 1, wherein in the closed position, a connecting line between the vertical connection axis and the door leaf-side vertical axis forms an angle between 40° and 60° with a connecting line between the vertical connection axis and the frame-side vertical axis.

10. A door hinge for hidden placement between a door frame and a door leaf as defined claim 1, wherein each of said hinge rods is a single piece element.

11. A door, comprising a door frame; a door leaf; and a door hinge hidden between said door frame and said door leaf and formed according to claim 1.

12. A door as defined in claim 11, wherein said door frame receiving body is located behind a non-milled out, plate-shaped laminate having a thickness of at least 10 mm.

13. A door as defined in claim 12, wherein an outer front surface of said door leaf is aligned with an outer surface of said laminate in the closed position.

* * * * *